US005298204A

United States Patent [19]

O'Connor et al.

[11] Patent Number: 5,298,204

[45] Date of Patent: Mar. 29, 1994

[54] METHOD OF BURNING OUT POLYCARBONATE PATTERNS FROM CERAMIC MOLDS

[75] Inventors: Kurt F. O'Connor, Carmel; James R. Stewart, Danville, both of Ind.

[73] Assignee: General Motors Corporation, Detroit, Mich.

[21] Appl. No.: 834,760

[22] Filed: Feb. 12, 1992

[51] Int. Cl.[5] ..... B29C 67/00; B29C 33/40

[52] U.S. Cl. ..... 264/25; 264/113; 264/125; 264/221; 264/317; 264/60

[58] Field of Search ..... 264/25, 80, 219, 317, 264/221, DIG. 44, 125, 113, 56, 60; 425/DIG. 12; 164/34; 156/62.2, 89, 272.8

[56] References Cited

U.S. PATENT DOCUMENTS

| | | | |
|---|---|---|---|
| 3,339,622 | 9/1967 | Horton | 264/221 |
| 3,672,787 | 6/1972 | Thorstenson | 416/97 |
| 4,283,835 | 8/1981 | Obrochta et al. | 29/527.6 |
| 4,314,007 | 2/1982 | Gessinger | 428/614 |
| 4,358,882 | 11/1982 | Wilkinson | 29/156.8 H |
| 4,375,233 | 3/1983 | Rossmann et al. | 164/9 |
| 4,561,491 | 12/1985 | Slack | 164/516 |
| 4,605,057 | 8/1986 | Sakai et al. | 164/519 |
| 4,763,715 | 8/1988 | Cannarsa et al. | 164/34 |
| 4,773,466 | 9/1988 | Cannarsa et al. | 164/34 |
| 4,863,538 | 9/1989 | Deckard | 156/62.2 |
| 4,989,664 | 2/1991 | Roth | 164/361 |

FOREIGN PATENT DOCUMENTS

WO90/03893 4/1990 PCT Int'l Appl. .

OTHER PUBLICATIONS

Stuart Uram, Certech Incorporated, "Assembly of Ceramic Cores to Form Complex Passageways", 29th Annual Meeting of the Investment Casting Institute, pp. 4a:01–4a:10.

Stuart Uram, Certech Incorporated, "Commercial Applications of Ceramic Cores", 26th Annual Meeting of the Investment Casting Institute 1978, pp. 10:1–10:12.

Description of Refractories Commonly Used in Investment Casting, submitted by Kurt O'Connor, Allison Gas Turbine, pp. 100–79–105–79; 106–82 (five pages); 120–79; 130–79.

Robert A. Horton, PCC Airfoils, Inc., "Investment Casting", pp. 253–269.

Sharon Machlis, Associate Editor, "How to Bring CAD to Life", Design News Technology Focus, Mar. 26, 1990, pp. 54–66.

R. O. Carhart et al., "Polycarbonate", Modern Plastics Encyclopedia 1979–1980, p. 48.

*Primary Examiner*—Jan H. Silbaugh
*Assistant Examiner*—Christopher A. Fiorilla
*Attorney, Agent, or Firm*—Cary W. Brooks

[57] ABSTRACT

A method of making a fused polycarbonate pattern for casting alloy structures, particularly gas-turbine blades, or components. A plurality of powder layers are fused together by a laser beam in a layer-by-layer fashion to produce the pattern. A pattern/casting mold is made and the pattern is burned out in a flash flame oven at a temperature ranging from about 1600° F. to about 2100° F. Preferably the burn-out step is conducted in the presence of an air stream so that the polycarbonate pattern is burned out ash free.

3 Claims, 1 Drawing Sheet

METHOD OF BURNING OUT POLYCARBONATE PATTERNS FROM CERAMIC MOLDS

FIELD OF THE INVENTION

This invention relates to polycarbonate casting patterns and methods of making, using and removing the same. More particularly, the invention relates to polycarbonate casting patterns made from a laser sintering process and a burn-out method of removal.

BACKGROUND OF THE INVENTION

The use of plastic patterns which could be burned out of a casting mold has heretofore been known. For example, polystyrene materials have been used to make patterns for casting molds and have been successfully burned out from the molds. Polystyrene has a relatively low melting point of about 165° F. to about 221° F. depending on the grade of material, with minimal expansion and trace impurities. Thus, polystyrene can be successfully used as a pattern to produce castings with dimensional accuracy. When polystyrene materials are heated out in the removal process, the polystyrene expands very little thus putting little pressure on the casting mold. As a consequence, the casting mold retains its shape and parts can be cast therefrom with dimensional accuracy. Further, the low number of impurities in polystyrene results in a burn-out with minimal ash content. Materials which have a high ash content are not desirable since such ash material requires further processing steps to remove or will leave imperfections in the surface of the part casted. In comparison, lithographic materials such as photopolymers can be used to make casting patterns. Unlike polystyrene, these materials expand greatly during the burn-out process which results in an uncontrollable change in the mold cast dimensions and often results in explosion of the casting mold. These types of materials also have associated with them an undesirable high level of ash content upon burn-out.

Polycarbonate has a melting point of approximately 300° F. to about 600° F. and an ash content of which is known to be greater than polystyrene.

Wax materials are commonly used in the making of patterns for the investment casting process. However, these wax patterns have drawbacks. In hot weather, or any warm environment, wax patterns have a tendency to become distorted or even melt. Wax patterns are very fragile and can be easily broken. Further, thin complicated designs are extremely difficult to create in such a pattern due to the weakness of thin wax walls.

Plastic pattern heretofore required expensive injection molding equipment to produce and the injection molding process frequently causes core breakage. Further, it is difficult to consistently position cores in the injection mold. Any plastic pattern must be completely removable by a solvent or have no ash content if the pattern is removed by a burn-out process.

Thus, it would be desirable to provide a process of making pattern which requires minimal handling of a core which the pattern surrounds, a process that does not explode the casting mold and wherein the pattern can be removed to provide a casting mold with dimensional accuracy and little or no ash content.

SUMMARY OF THE INVENTION

Generally, the present invention includes a method of making a pattern for casting alloy parts including the steps of sequentially fusing together a plurality of regions of polycarbonate powder in a layer-by-layer fashion to produce the pattern. A casting mold is made around the polycarbonate pattern and the polycarbonate pattern is burned out ash free in a flash flame oven at a temperature ranging from about 1600° F. to about 2100° F. Preferably, the burn-out step is performed in the presence of an oxygen stream. A pattern/core combination may be made by the powder fusion process.

These and other objects, features, and advantages will be apparent from the following brief description of the drawings, detailed description and appended drawings and claims.

DETAILED DESCRIPTION OF THE INVENTION

Figure 1:
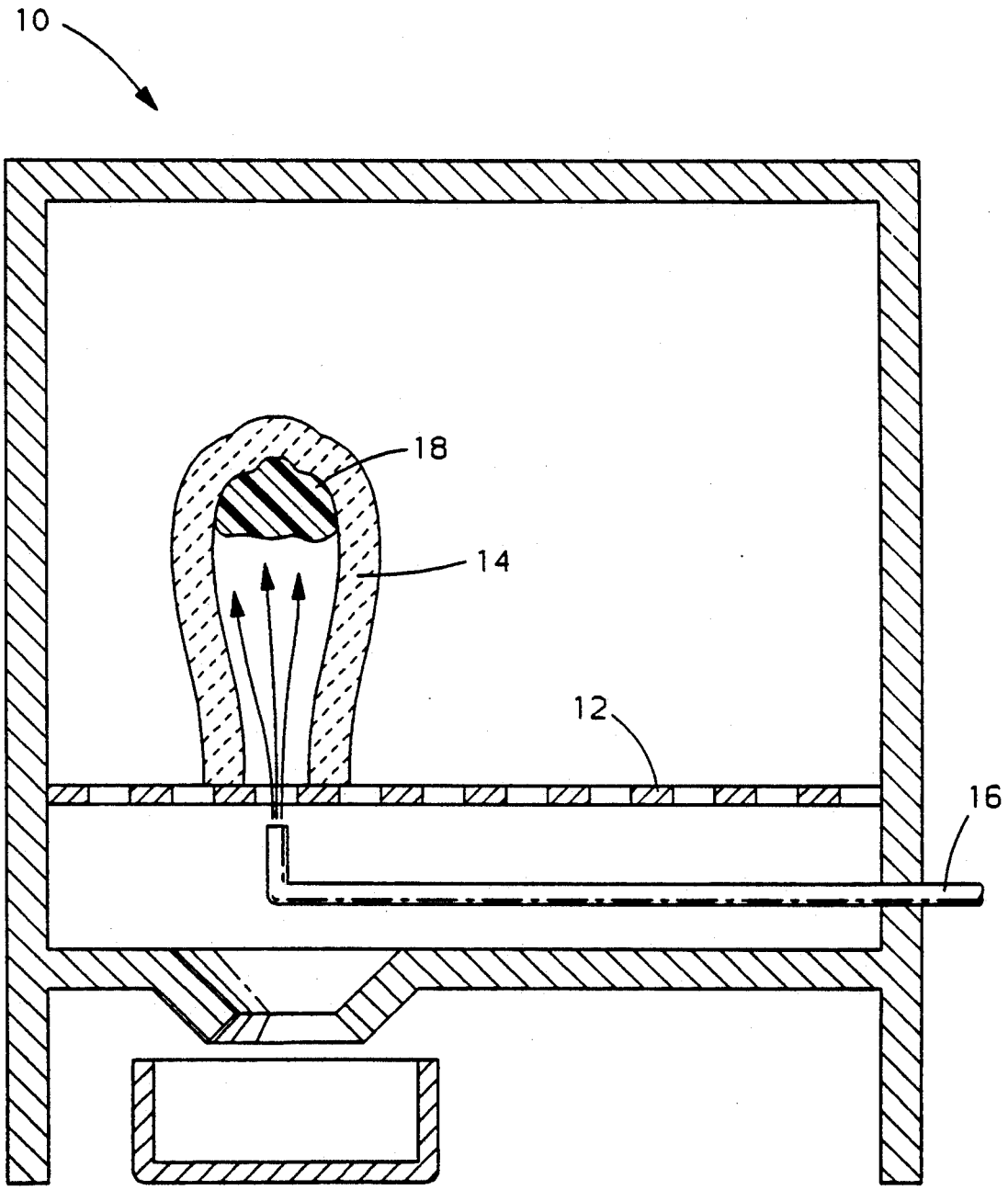
FIG. 1 illustrates a process according to the present invention including burning out a polycarbonate pattern in a flash flame oven in the presence of an air stream.

As stated above, the invention includes a method of making a pattern by sequentially fusing together regions of polycarbonate material (or powder) in a layer-by-layer fashion to produce the pattern. A suitable polycarbonate material is available from General Electric Co. under the trade name Lexan. The polycarbonate may have a melting point ranging from about 300° F. to about 600° F. depending on the grade.

Preferably, the layers of powder are fused together by directing a laser beam onto successive layers of powder. A suitable apparatus and method of operation for accomplishing the laser fusion of powdered material is described in U.S. Pat. No. 4,863,538, the disclosure of which is hereby incorporated by reference. The fusing together of the powder layers may be accomplished by directing wave energy onto predetermined patterns of the powder. Such wave energy may include an electron beam.

As described in U.S. Pat. No. 4,863,538, an apparatus useful in connection with the present invention includes a laser or other directed energy source which is selectable for emitting a beam on a target area where a part is to be produced. A powdered dispensing system deposits powder onto the target area. A control mechanism operates to selectively fuse or sinter only the powder disposed within the fine boundaries to produce the desired layer of the part. The control mechanism operates the laser to selectively sinter or fuse sequential layers of the powder, producing a completed part comprising a plurality of layers sintered or fused together. The defined boundaries of each layer correspond to respective cross-section regions of the part. The control mechanism may include a computer such as a CAD/CAM system to determine the defined boundaries of each layer. Given the overall dimensions and configuration of the part to be produced, the computer determines the defined boundaries for each layer and operates a laser control mechanism in accordance with the defined boundaries.

The laser control mechanism may include a means for directing the laser beam on the target area and a means for modulating the laser beam between on and off positions or a shuttering means to selectively sinter or fuse the powder in the target area to produce varying configurations as desired. The directing mechanism may operate to move the aim of the laser beam in a continuous raster scan of the target area. A modulating mechanism turns the laser beam on and off so that the powder is sintered or fused only when the aim of the laser beam is within the defined boundaries for the particular layer. The directing mechanism may aim the laser beam only within defined boundaries for the particular layer so that the laser beam can be left on continuously to sinter the powder within the defined boundaries of the particular layer.

The directing mechanism may move the laser beam in a respective raster scan of the target area using mirrors driven by galvanometers. A first mirror may reflect the laser beam to a second mirror which may reflect the beam onto the target. Movement of the first mirror by its galvanometer shifts the laser beam generally in one direction in the target area. Movement of the second mirror by its galvanometer shifts the laser beam in the target area in a second direction. The mirrors may be oriented relative to each other so that the first and second directions are generally perpendicular to each other. This arrangements allows for many different types scanning patterns of the laser beam in the target area, including a raster scan pattern.

The dispensing of the powder may be assisted by using a confinement structure which defines the outer perimeter of each layer. Each layer may be defined by a separate confinement structure or the entire part may be defined by a single confinement structure. When passages or voids in a particular layer are desirable, such may be obtained by simply not sintering or fusing the powder in the area for the void or passage. After the selective portions of the layer have been fused, the loose powder may be brushed away or blown off to define the void or passage. Alternatively, a passage or void may be defined by placing a different type of material on top of the previous fused layer at the location of the void or passage and depositing the next loose powder layer around the insert and thereafter fusing the powder. Preferably, the insert would be constructed of material and positioned such that it may be dissolved or otherwise removed after the powder is fused together to form the void or passage.

A pattern/core combination may be produced as follows. The steps of the method of the present invention include the following. First, a three-dimensional configuration of the hollow portion of a gas-turbine blade or component must be determined. Second, a three-dimensional configuration of the blade or component must be determined. The core may be produced by fusing together layers of ceramic powder, preferably quartz, in a layer-by-layer fashion corresponding to discrete cross-sectional regions of the hollow portion of the gas-turbine blade. A first layer of powder comprising ceramic material is deposited on a substrate in a predetermined pattern corresponding to a first cross-sectional region of the hollow portion of the gas-turbine blade. The first layer of powder is fused together by directing a laser beam over the predetermined pattern of the first layer of ceramic powder to form a first fused layer of ceramic having the shape of the first cross-sectional region of the hollow portion. Likewise, the pattern may be produced by fusing together regions of polycarbonate powder, which may be deposited adjacent the ceramic powder or fused ceramic, and in a manner consistent with forming each layer of the core. A second layer of ceramic powder is deposited on the first layer of fused ceramic or fused wax or plastic in a second predetermined pattern corresponding to a second cross-sectional region of the hollow portion which is immediately adjacent to the first cross-sectional region. The second layer of powder is fused together by directing a laser beam over the second predetermined pattern to form a second fused layer of ceramic having the shape of the second cross-sectional region of the hollow portion, and so that the second fused layer is fused to the first fused layer. The second layer of the pattern is formed in a similar fashion as described above. Successive layers of powder are deposited onto previous fused layers in predetermined patterns corresponding to respective cross-sectional regions of the hollow portion of the core and of the pattern. Each of the successive layers of powder is fused together to form successive fused layers, wherein each of the successive fused layers are fused to a previously fused layer to form the core having a configuration corresponding to the hollow portion of the gas-turbine blade or component, and a pattern having a configuration corresponding to the blade or component.

The core/pattern combination may be used to make a gas-turbine blade. A readily removable casting mold is placed around the pattern and the core so that it conforms to the outer surface of the pattern. A typical investment ceramic cast mold may contain $SiO_2$, $ZrSiO_4$ or $AlO_2$.

The polycarbonate pattern may be removed in a special burn-out procedure. The polycarbonate pattern/mold combination is placed in a flash flame oven at a temperature ranging from about 1600° F. to about 2100° F., and preferably about 2000° F. The temperature is such that the pattern may be burned out without exploding the ceramic mold. For a pattern having a size of about 0.005 inches to about 0.2 inches, 1.5 hours at 2000° F. is sufficient to burn the pattern out. The mold may then be rinsed out and air dried. Preferably, the mold 14 with pattern removed is placed on a grid 12 in the flash flame oven 10 and an air supply tube 16 is positioned under the pattern/mold combination. Air is supplied through the tube so that air enters the cavity formed as the pattern 18 is being burned out and so that the burn-out is assisted by the presence of the air. In this way detail structures of the pattern can be burned out ash free.

The laser sintering process is preferred for making the polycarbonate pattern over an injection molding technique. Injection molding requires a new tool to be made for every modification and is thus expensive and time consuming. Modification can be made in the laser sintering produce by simply changing the program that runs the process and is thus easy, quick and inexpensive.

The embodiments of the invention in which an exclusive property or privilege is claimed are defined as follows:

1. A method of burning a polycarbonate pattern out of a ceramic casting mold comprising the steps of:

providing a ceramic casting mold around a polycarbonate pattern wherein the ceramic casting mold conforms to the outer surface of the polycarbonate pattern; and heating the polycarbonate pattern in a flash flame oven at a temperature ranging from about 1600° F. to about 2100° F. to burn out the polycarbonate pattern without causing the ceramic casting mold to explode.

2. A method as set forth in claim 1 further comprising the step of providing an air stream impinging on said polycarbonate pattern during said step of heating so that said polycarbonate pattern is burned out substantially ash free.

3. A method as set forth in claim 1 wherein said polycarbonate pattern surrounds a core and further including the step of making the core surrounded by the polycarbonate pattern comprising the steps of:

depositing a first layer of powder comprising a ceramic onto a substrate in a predetermined pattern corresponding to a first cross-sectional region of a hollow portion of a gas-turbine blade or component;

fusing together said first layer of ceramic powder by directing a laser beam over the predetermined pattern of said first layer of powder to form said fused layer of ceramic having a shape of said first cross-sectional region of said hollow portion;

depositing a first layer comprising polycarbonate powder on said substrate in a predetermined pattern corresponding to a first cross-sectional region of said blade or component;

fusing together said first layer of polycarbonate powder by directing a laser beam over the predetermined pattern corresponding to said first cross-section of blade or component to form a fused layer of polycarbonate material having a shape corresponding to said first cross-sectional region of said blade component;

the fused regions of ceramic and the fused regions polycarbonate material of the first layer forming a first fused layer;

depositing a second layer of ceramic powder onto said first fused layer in a second predetermined pattern corresponding to a second cross-sectional region of said hollow portion which is immediately adjacent said first cross-sectional region for the same;

fusing said second layer of ceramic powder by directing a laser beam over said second predetermined pattern of said hollow portion to form a second fused layer of ceramic having the shape of said second cross-sectional region of said hollow portion, and so that said second fused layer of ceramic is fused to said first fused layer;

depositing a second layer comprising polycarbonate powder onto said first fused layer in a second predetermined pattern corresponding to a second cross-sectional region of said blade or component which is immediately adjacent to the first cross-sectional region for the same;

fusing said second layer of polycarbonate powder by directing a laser beam over said second predetermined pattern of said blade or component to form a second fused layer of polycarbonate material having the shape of said second cross-sectional region of said blade or component, and so that said fused layer of polycarbonate material or ceramic is fused to said first fused layer; and depositing successive layers of powder onto previous fused layers of ceramic or fused layers of polycarbonate material in predetermined patterns corresponding to a respective cross-sectional regions of said hollow portion and said blade or component, and fusing each of said successive layers of powder to form successive fused layers, wherein each of said successive fused layers are fused to a previous fused layer to form said core having a configuration corresponding to said hollow portion of said gas-turbine blade and a pattern having a configuration corresponding to said blade or component.

* * * * *